US007337586B2

(12) United States Patent
Lin et al.

(10) Patent No.: US 7,337,586 B2
(45) Date of Patent: Mar. 4, 2008

(54) ANTI-SEISMIC DEVICE WITH VIBRATION-REDUCING UNITS ARRANGED IN PARALLEL

(76) Inventors: Chi-Chang Lin, 4F, No. 92, Nan-Yang St., Nan Dist., Taichung City (TW); Jer-Fu Wang, No. 246, Kuo-Feng 3rd St., Tso-Yuan City (TW)

( * ) Notice: Subject to any disclaimer, the term of this patent is extended or adjusted under 35 U.S.C. 154(b) by 581 days.

(21) Appl. No.: 10/867,040

(22) Filed: Jun. 14, 2004

(65) Prior Publication Data

US 2005/0274084 A1 Dec. 15, 2005

(51) Int. Cl.
*E04B 1/98* (2006.01)

(52) U.S. Cl. ..... 52/167.1; 52/167.4; 52/167.6; 52/167.7

(58) Field of Classification Search ..... 52/573.1, 52/167.9, 167.8, 167.7, 167.6, 167.5, 167.4, 52/167.3, 167.2, 167.1, 1; 248/562, 636
See application file for complete search history.

(56) References Cited

U.S. PATENT DOCUMENTS 4,402,483 A * 9/1983 Kurabayashi et al. ..... 248/636
5,100,096 A * 3/1992 Mizuno et al. ..... 248/638
5,558,191 A * 9/1996 Lai ..... 188/379
7,107,728 B2 * 9/2006 Whitley ..... 52/167.4

* cited by examiner

*Primary Examiner*—Basil Katcheves
(74) *Attorney, Agent, or Firm*—Ohlandt, Greeley, Ruggiero & Perle, L.L.P.

(57) ABSTRACT

An anti-seismic device is adapted to absorb the vibration energy of a structure, and comprises a plurality of vibration-reducing units, each of which includes a mass, a hydraulic cylinder, and a resilient element. The hydraulic cylinder has an outer end that is connected fixedly to the structure, and an inner end that is connected fixedly to the mass. The resilient element has an outer end that is connected to the structure, and an inner end that is connected to the mass. When the structure is subjected to vibration, the masses can move reciprocally relative to the structure at different vibration frequencies. The hydraulic cylinders are arranged substantially in parallel.

4 Claims, 6 Drawing Sheets

ANTI-SEISMIC DEVICE WITH VIBRATION-REDUCING UNITS ARRANGED IN PARALLEL

BACKGROUND OF THE INVENTION

1. Field of the Invention

This invention relates to an anti-seismic device, and more particularly to an anti-seismic device that includes a plurality of vibration-reducing units which are arranged in parallel.

2. Description of the Related Art

In a tuned mass damping system, a mass is suspended from a building structure by a steel cable so as to diminish oscillations in the building structure. By correctly matching the mass with the relevant parameters of the building structure, the mass can oscillate in a direction opposite to that of the oscillation direction of the building so as to absorb the vibration energy of the building structure.

The aforesaid mass damping system suffers from the following disadvantages:

(1) When errors occur in evaluation of the natural frequency of the building during installation of the system, or when change in the structure of the building takes place, the mass cannot oscillate at the optimum vibration frequency when an earthquake occurs, thereby reducing the vibration-reducing effect.

(2) In an application of the system to a tall building, the mass typically has a weight of several tons. As a result, a relatively large space must be provided to allow for oscillation of the mass. This also necessitates the provision of a safety protective arrangement that is disposed around the space, and makes installation of the system in the building difficult.

(3) The system can absorb only horizontal vibration energy of a building.

SUMMARY OF THE INVENTION

The object of this invention is to provide an anti-seismic device that can overcome the disadvantages associated with the above-mentioned prior art.

According to this invention, an anti-seismic device is adapted to absorb the vibration energy of a structure, and comprises a plurality of vibration-reducing units, each of which includes a mass, a hydraulic cylinder, and a resilient element. The hydraulic cylinder has an outer end that is connected fixedly to the structure, and an inner end that is connected fixedly to the mass. The resilient element has an outer end that is connected to the structure, and an inner end that is connected to the mass. When the structure is made to vibrate, the masses move reciprocally relative to the structure at different vibration frequencies. The hydraulic cylinders are arranged substantially in parallel.

Because the masses reciprocate at different vibration frequencies so that the device has a vibration frequency width, the natural frequency of the structure is apt to fall within the frequency width. This enhances the overall vibration-reducing effect of the device.

Each of the masses is relatively lightweight, and therefore is easy to install on the structure.

The hydraulic cylinders can be disposed horizontally so as to absorb horizontal vibration energy of the structure, and vertically so as to absorb vertical vibration energy of the structure.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
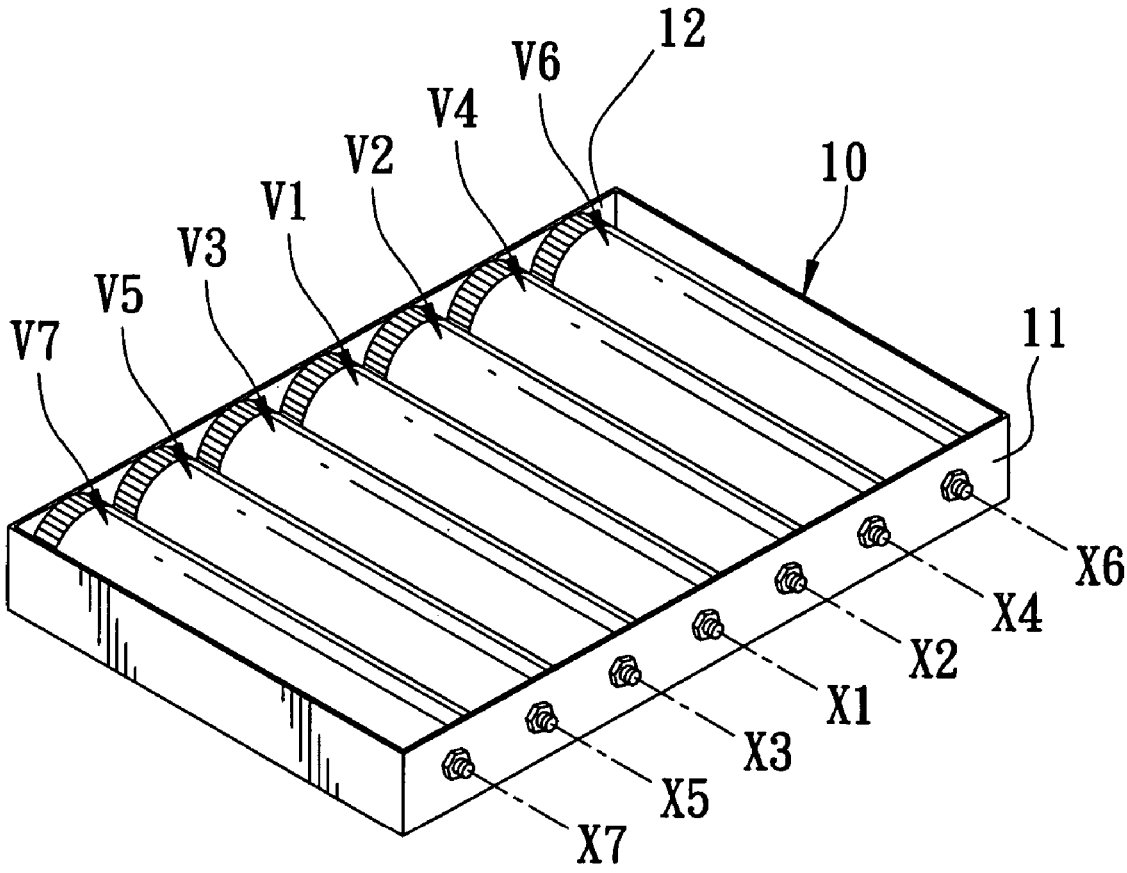
FIG. 1 is a perspective view of the preferred embodiment of an anti-seismic device according to this invention.
Figure 2:
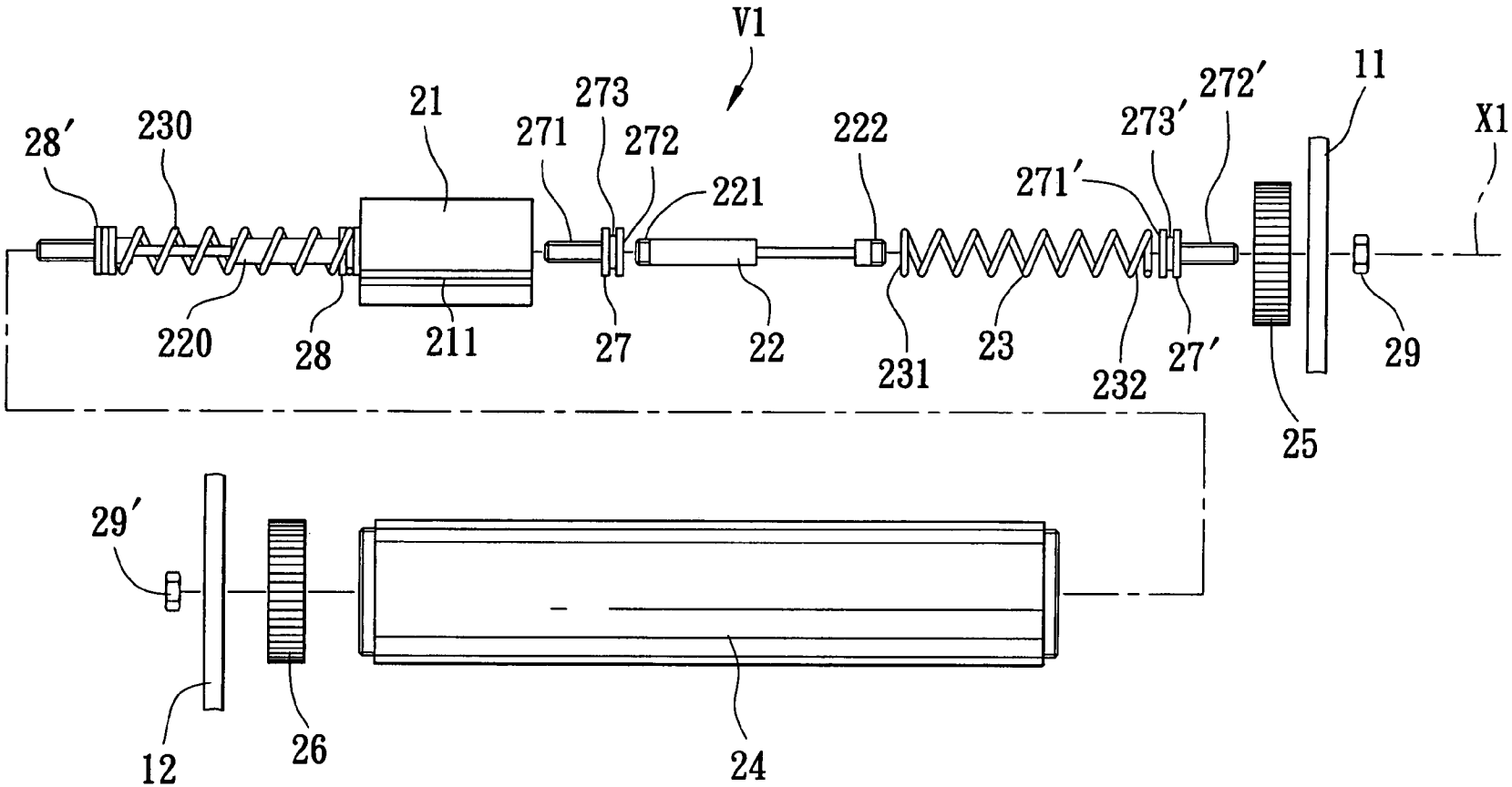
FIG. 2 is an exploded side view of one vibration-reducing unit of the preferred embodiment.
Figure 3:
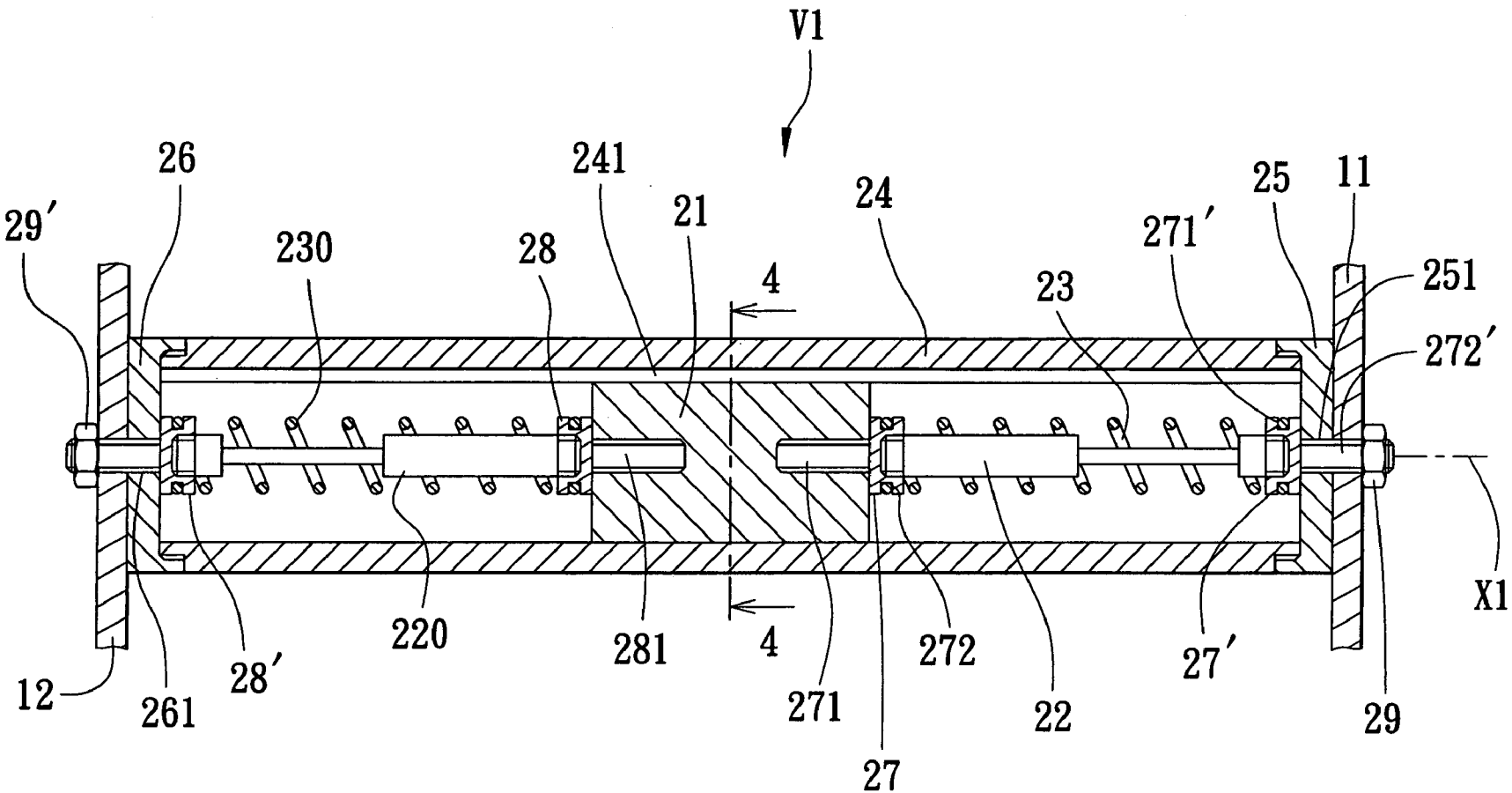
FIG. 3 is an assembled side view of the vibration-reducing unit of the preferred embodiment.

Referring to FIGS. 1, 2, and 3, the preferred embodiment of an anti-seismic device according to this invention is shown to include a rectangular frame 10, and first, second, third, fourth, fifth, sixth, and seventh vibration-reducing units V1, V2, V3, V4, V5, V6, V7. The frame 10 has opposite first and second walls 11, 12 parallel to each other and disposed between and connected respectively and fixedly to first and second portions 201, 202 (see FIG. 6) of a structure 200 (see FIGS. 5 and 6), and is disposed around the first, second, third, fourth, fifth, sixth, and seventh vibration-reducing units V1, V2, V3, V4, V5, V6, V7. The first, second, third, fourth, fifth, sixth, and seventh vibration-reducing units V1, V2, V3, V4, V5, V6, V7 are arranged substantially in parallel, and are similar in construction. As a result of this similarity in structure, only the first vibration-reducing unit V1 will be described in greater detail hereinafter.

The first vibration-reducing unit V1 includes a mass 21, a first hydraulic cylinder 22, a second hydraulic cylinder 220, a first resilient element 23, a second resilient element 230, a sleeve 24, a first cap 25, a second cap 26, a pair of inner and outer first threaded elements 27, 27', a pair of inner and outer second threaded elements 28, 28', a first nut 29, and a second nut 29'.

The mass 21 is disposed movably within the sleeve 24, and has an annular outer surface that is formed with a plurality of axial slots 211.

The first hydraulic cylinder 22 is disposed within the sleeve 24, and has externally threaded inner and outer ends 221, 222 that engage respectively an internally threaded and enlarged outer end 272 of the inner first threaded element 27 and an internally threaded and enlarged inner end 271' of the outer first threaded element 27'.

Likewise, the second hydraulic cylinder 220 is disposed within the sleeve 24, and has externally threaded inner and outer ends that engage respectively an internally threaded and enlarged outer end of the inner second threaded element 28 and an internally threaded and enlarged inner end of the outer first threaded element 28'. The first and second hydraulic cylinders 22, 220 are aligned with each other along an axial direction of the first vibration-reducing unit V1.

The first resilient element 23 is disposed within the sleeve 24, is configured as a coiled spring, and is sleeved on the first hydraulic cylinder 22. An inner end 231 of the first resilient element 23 is received within an annular groove 273 in the outer end 272 of the inner first threaded element 27. An outer end 232 of the first resilient element 23 is received within an annular groove 273' in the inner end 271' of the outer first threaded element 27'.

Likewise, the second resilient element 230 is disposed within the sleeve 24, is configured as a coiled spring, and is sleeved on the second hydraulic cylinder 220. An inner end of the second resilient element 230 is received within an annular groove in the outer end of the inner second threaded element 28. An outer end of the second resilient element 230 is received within an annular groove in the inner end of the outer second threaded element 28'.

Figure 4:
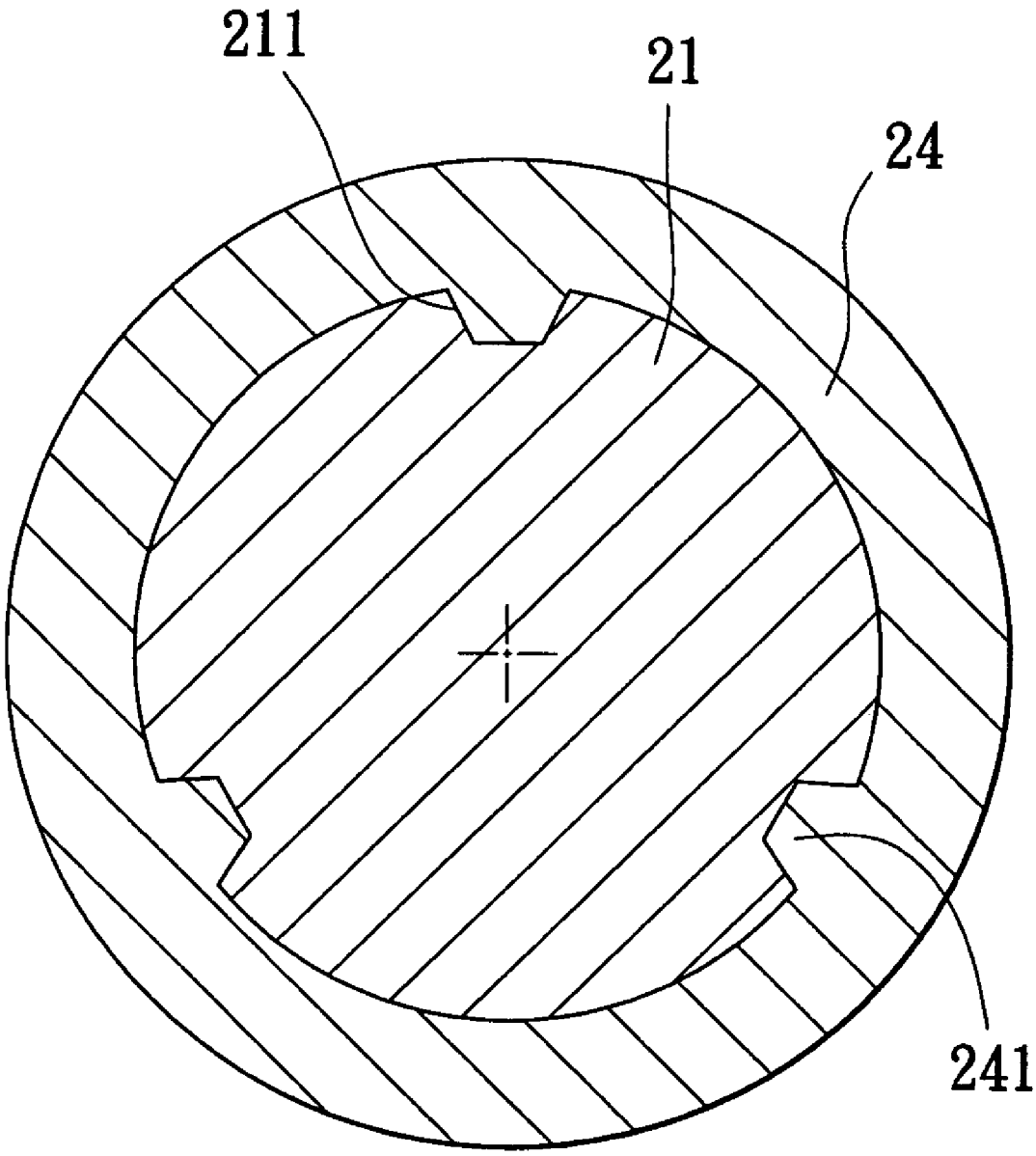
FIG. 4 is a sectional view of the preferred embodiment taken along Line 4-4 in FIG. 3.

The sleeve 24 is disposed between the first and second walls 11, 12 of the rectangular frame 10, and has an inner surface that is formed with a plurality of axial ribs 241 (see FIG. 4) which are received respectively and slidably within the slots 211 in the mass 21. Therefore, rotation of the mass 21 within the sleeve 24 is prevented, while axial movement of the mass 21 within the sleeve 24 is allowed.

The first and second caps 25, 26 are sleeved respectively and fixedly on two ends of the sleeve 24.

The inner first and second threaded elements 27, 28 have externally threaded inner ends 271, 281 engaging respectively two internally threaded ends of the mass 21. Thus, the inner end 221 of the first hydraulic cylinder 22 and the inner end of the second hydraulic cylinder 220 are fixed to the mass 21.

The outer first threaded element 27' extends through a central hole 251 in the first cap 25 and the first wall 11 of the rectangular frame 10, and has an externally threaded outer end 272' engaging the first nut 29. Therefore, the first cap 25 and the first wall 11 are clamped between the first nut 29 and the enlarged inner end 271' of the outer first threaded element 27'. As a consequence, the outer end 222 of the first hydraulic cylinder 22 is fixed to the first wall 11.

Likewise, the outer second threaded element 28' extends through a central hole 261 in the second cap 26 and the second wall 12 of the rectangular frame 10, and has an externally threaded outer end engaging the second nut 29'. Therefore, the second cap 26 and the second wall 12 are clamped between the second nut 29' and the enlarged inner end of the outer second threaded element 28'. As a consequence, the outer end of the second hydraulic cylinder 220 is fixed to the second wall 12.

The vibration frequency of the mass 21 can be adjusted by changing the weight of the mass 21 and/or the damping coefficient of the first and second hydraulic cylinders 22, 220 and/or the elastic modulus of the first and second resilient elements 23, 230. To simplify the adjustment of the vibration frequency, the weights of the masses 21 of the first, second, third, fourth, fifth, sixth, and seventh vibration-reducing units V1, V2, V3, V4, V5, V6, V7 are made different; the first and second hydraulic cylinders 22 of the first, second, third, fourth, fifth, sixth, and seventh vibration-reducing units V1, V2, V3, V4, V5, V6, V7 have the same damping coefficient; and the first and second resilient elements 23, 230 of the first, second, third, fourth, fifth, sixth, and seventh vibration-reducing units V1, V2, V3, V4, V5, V6, V7 have the same elastic modulus. As a consequence, the vibration frequencies of the masses 21 of the first, second, third, fourth, fifth, sixth, and seventh vibration-reducing units V1, V2, V3, V4, V5, V6, V7 are different.

The first hydraulic cylinders 22 of the first, second, third, fourth, fifth, sixth, and seventh vibration-reducing units V1, V2, V3, V4, V5, V6, V7 are arranged substantially in parallel. Likewise, the second hydraulic cylinders 220 of the first, second, third, fourth, fifth, sixth, and seventh vibration-reducing units V1, V2, V3, V4, V5, V6, V7 are arranged substantially in parallel.

When the structure 200 (see FIGS. 5 and 6) undergoes vibration, the masses 21 of the first, second, third, fourth, fifth, sixth, and seventh vibration-reducing units V1, V2, V3, V4, V5, V6, V7 reciprocate within the sleeves 24 along parallel axes (x1, x2, x3, x4, x5, x6, x7) of the sleeves 24, respectively, at different vibration frequencies so as to establish a vibration frequency width of the anti-seismic device. Therefore, the natural frequency of the structure 200 (see FIGS. 5 and 6) is apt to fall within the vibration frequency width so as to increase the vibration-reducing effect of the anti-seismic device of this invention. The number of the vibration-reducing units V1, V2, V3, V4, V5, V6, V7 can be increased to increase the vibration frequency width.

Figure 5:
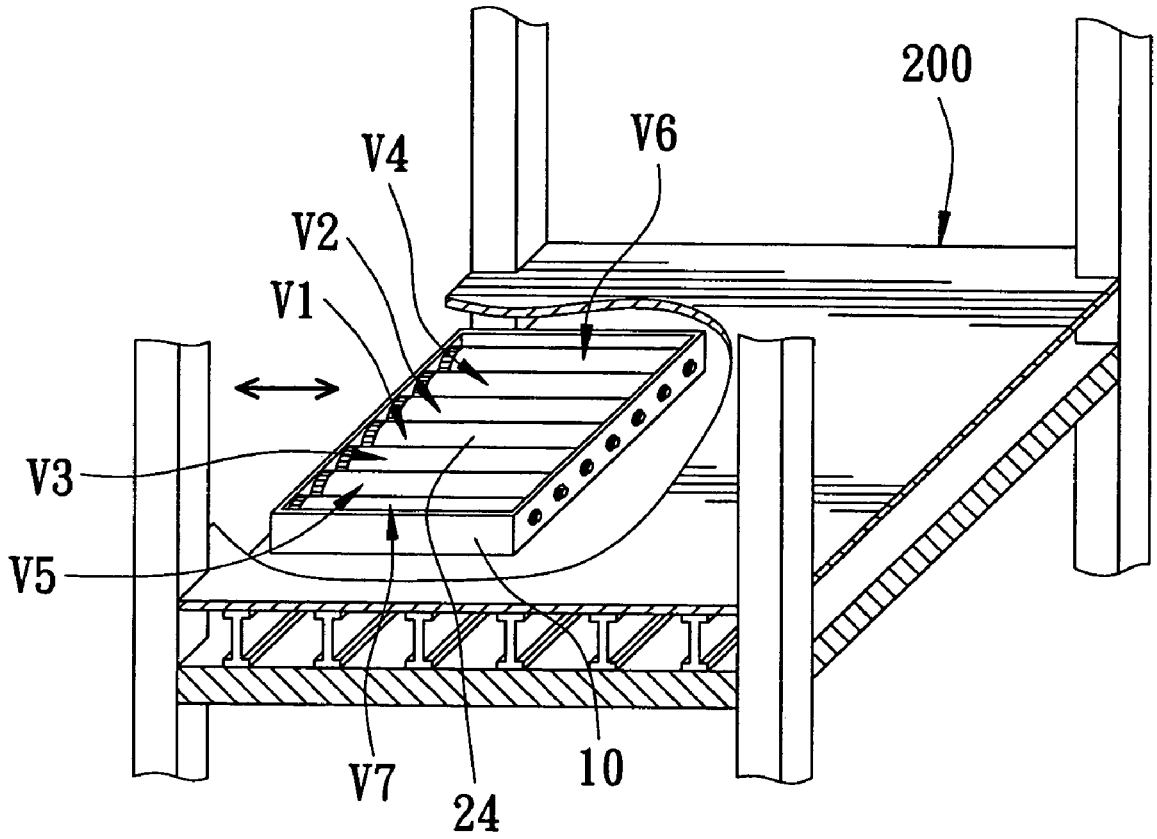
FIG. 5 is a perspective view illustrating how the preferred embodiment is applied to a building so as to absorb horizontal vibration energy of the building.

Referring to FIG. 5, the structure 200 may be a building. The rectangular frame 10 is attached fixedly to a floor or ceiling of the structure 200. The sleeves 24 of the first, second, third, fourth, fifth, sixth, and seventh vibration-reducing units V1, V2, V3, V4, V5, V6, V7 are horizontally positioned. As such, the anti-seismic device of this invention can absorb horizontal vibration energy of the structure 200.

Figure 6:
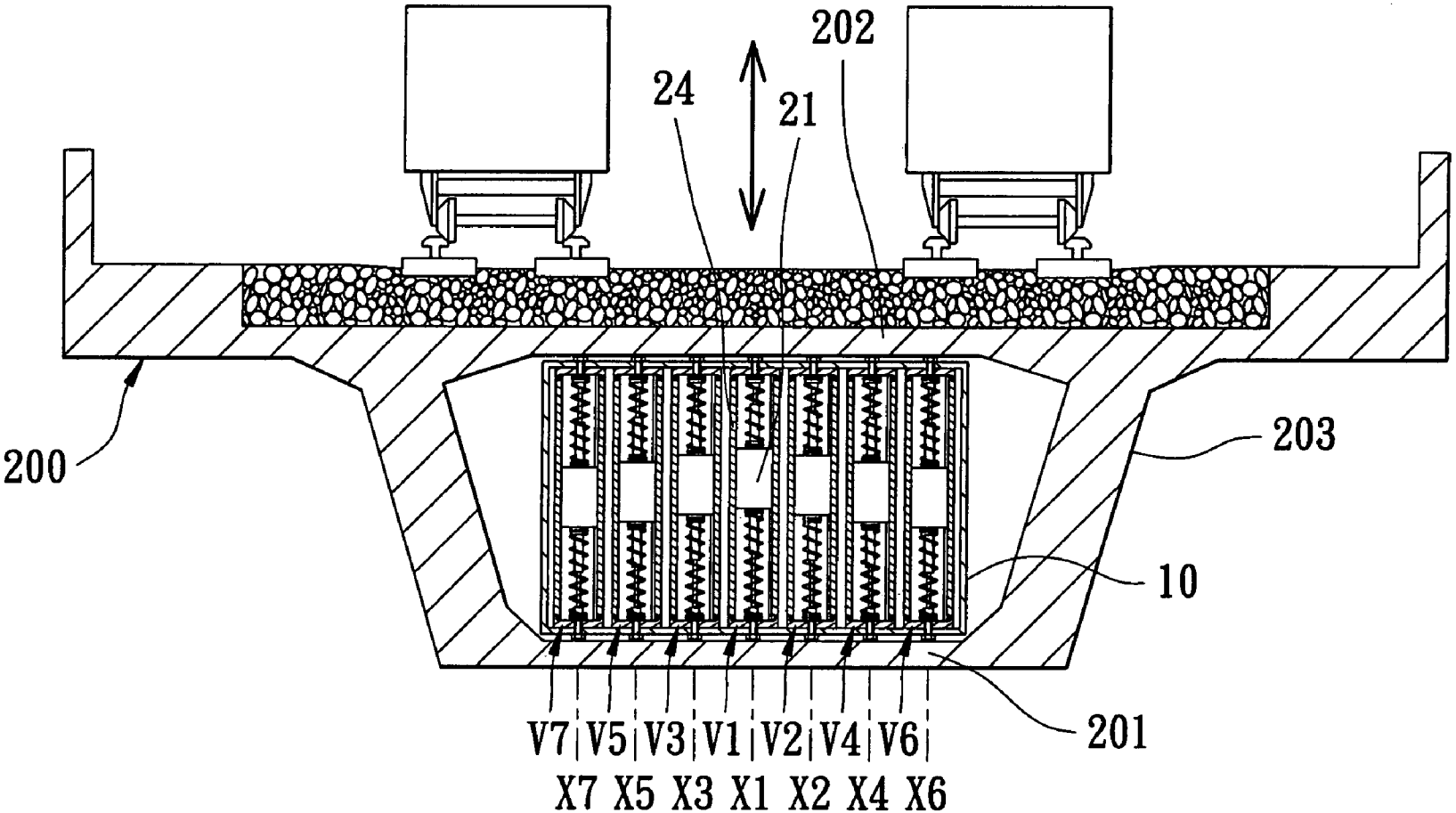
FIG. 6 is a sectional view illustrating how the preferred embodiment is applied to a rail-supporting bridge so as to absorb vertical vibration energy of the bridge.

Referring to FIG. 6, the structure 200 may be a rail-supporting bridge. The rectangular frame 10 is fixed within a hollow downward projection 203 of the structure 200. The sleeves 24 of the first, second, third, fourth, fifth, sixth, and seventh vibration-reducing units V1, V2, V3, V4, V5, V6, V7 are vertically positioned. Hence, the anti-seismic device of this invention can absorb vertical vibration energy of the structure 200.

The anti-seismic device of this invention has the following advantages:

(1) Because the anti-seismic device of this invention has the vibration frequency width as described above, when there is an error occurring in evaluation of the natural frequency of the structure 200 during installation of the anti-seismic device, or when structural change in the structure 200 takes place, the actual vibration frequency of the structure 200 will still fall within the vibration frequency width.

(2) Each of the masses 21 is relatively small in volume and weight, and therefore easy to transport and install. Therefore, the anti-seismic device of this invention can be installed in a comparatively small area.

(3) The anti-seismic device of this invention can be disposed so that the sleeves 24 are horizontal or vertical, thereby enabling the absorption of horizontal or vertical vibration energy of the structure 200.

(4) The vibration frequencies of the first, second, third, fourth, fifth, sixth, and seventh vibration-reducing units V1, V2, V3, V4, V5, V6, V7 can be adjusted easily by changing the weights of the masses 21.

With this invention thus explained, it is apparent that numerous modifications and variations can be made without departing from the scope and spirit of this invention. It is therefore intended that this invention be limited only as indicated by the appended claims.

We claim:

1. An anti-seismic device adapted to absorb vibration energy of a structure, the structure having a first portion and a second portion, said anti-seismic device comprising a plurality of vibration-reducing units, each of which includes:

a mass adapted to be disposed movably between the first and second portions of the structure;

a first hydraulic cylinder having an outer end that is adapted to be connected fixedly to the first portion of the structure, and an inner end that is opposite to said outer end and that is connected fixedly to said mass; and a first resilient element having an outer end that is adapted to be connected to the first portion of the structure, and an inner end that is connected to said mass;

said masses of said vibration-reducing units being movable reciprocally relative to the structure at different vibration frequencies when the structure is made to vibrate, said first hydraulic cylinders of said vibration-reducing units being arranged substantially parallel to each other;

wherein each of said vibration-reducing units further includes:

a rectangular frame having opposite first and second walls that are parallel to each other and that are adapted to be connected respectively and fixedly to the first and second portions of the structure;

a sleeve disposed between said first and second walls of said rectangular frame and around said mass, said first and second hydraulic cylinders of said vibration-reducing units, and said first and second resilient elements of the corresponding one of said vibration-reducing units;

first and second caps disposed between said first and second walls of said rectangular frame and sleeved respectively and fixedly on two ends of said sleeve;

a first nut;

a pair of inner and outer first threaded elements, said outer first threaded element extending through said first cap and said first wall of said rectangular frame and having an externally threaded outer end engaging said first nut, and an enlarged inner end connected threadedly to said outer end of said first hydraulic cylinder of the corresponding one of said vibration-reducing units so as to clamp said first cap and the first wall of said rectangular frame between said first nut and said enlarged inner end of said outer first threaded element, said inner first threaded element having two ends connected respectively threadedly to said inner end of said first hydraulic cylinder and said mass of the corresponding one of said vibration-reducing units;

a second nut; and a pair of inner and outer second threaded elements, said outer second threaded element extending through said second cap and said second wall of said rectangular frame and having an externally threaded outer end engaging said second nut, and an enlarged inner end connected threadedly to said outer end of said second hydraulic cylinder of the corresponding one of said vibration-reducing units so as to clamp said second cap and said second wall of said rectangular frame between said second nut and said enlarged inner end of said outer second threaded element, said inner second threaded element having two ends connected respectively threadedly to said inner end of said second hydraulic cylinder and said mass of the corresponding one of said vibration-reducing units.

2. The anti-seismic device as claimed in claim 1, wherein each of said vibration-reducing units further includes:

a second hydraulic cylinder aligned with said first hydraulic cylinder of a corresponding one of said vibration-reducing units and having an outer end that is adapted to be connected fixedly to the second portion of the structure, and an inner end that is opposite to said outer end and that is connected fixedly to said mass; and a second resilient element having an outer end that is adapted to be connected to the second portion of the structure, and an inner end that is connected to said mass;

said masses of said vibration-reducing units being movable reciprocally relative to the structure at different vibration frequencies when the structure is subjected to vibration, said second hydraulic cylinders of said vibration-reducing units being arranged parallel to each other.

3. The anti-seismic device as claimed in claim 1, wherein each of said sleeves has an inner surface that is formed with a plurality of axial slots, each of said masses of said vibration-reducing units having an annular outer surface that is formed with a plurality of axial ribs which are received respectively and slidably within said slots in a corresponding one of said sleeves so as to allow axial movement of said masses of said vibration-reducing units within said sleeves and so as to prevent rotation of said masses of said vibration-reducing units within said sleeves.

4. The anti-seismic device as claimed in claim 1, wherein each of said enlarged outer ends of said inner first and second threaded elements and said enlarged inner ends of said outer first and second threaded elements has an annular outer surface that is formed with an annular groove, each of said first and second resilient elements being configured as a coiled spring that is sleeved on a corresponding one of said first and second hydraulic cylinders of said vibration-reducing units and that has two ends, each of which is received within said annular groove in a corresponding one of said inner first and second threaded elements and said outer first and second threaded elements.

* * * * *